United States Patent [19]

De Giulio

[11] Patent Number: 4,911,325

[45] Date of Patent: Mar. 27, 1990

[54] FLEXIBLE WALL TRASH CONTAINER FOR A CABINET DOOR

[76] Inventor: John P. De Giulio, 5915 Da Costa, Dearborn Heights, Mich. 48127

[21] Appl. No.: 324,384

[22] Filed: Mar. 16, 1989

[51] Int. Cl.[4] ..... A47B 81/00; B65D 91/00

[52] U.S. Cl. ..... 220/404; 220/1 T; 220/18; 312/212

[58] Field of Search ..... 220/1 T, 18, 404; 312/211, 212, 228

[56] References Cited

U.S. PATENT DOCUMENTS

| | | | |
|---|---|---|---|
| D. 29,381 | 3/1988 | Fischer et al. | D23/271 |
| 3,653,620 | 4/1972 | Benoit | 248/101 |
| 3,694,046 | 9/1972 | Gehrmann | 312/196 |
| 3,741,434 | 6/1973 | Traverse . | |
| 3,788,720 | 1/1974 | Schneider | 312/211 |
| 3,799,430 | 3/1974 | Huguenin | 232/43.2 |
| 3,839,954 | 10/1974 | Bourgeois | 100/229 A |
| 4,013,215 | 3/1977 | Mercier | 232/43.1 |
| 4,137,578 | 2/1979 | Felici | 4/255 |
| 4,664,455 | 5/1987 | Greenhow | 312/211 |
| 4,691,837 | 9/1987 | Dillon | 220/1 T |
| 4,776,480 | 10/1988 | Triadu et al. | 220/18 |

FOREIGN PATENT DOCUMENTS

| | | | |
|---|---|---|---|
| 2200153 | 9/1972 | Fed. Rep. of Germany | 220/1 T |
| 0144277 | 2/1954 | Sweden | 220/18 |
| 0220713 | 7/1942 | Switzerland | 220/18 |
| 0419222 | 11/1934 | United Kingdom | 220/18 |
| 0571577 | 8/1945 | United Kingdom | 220/18 |
| 0945492 | 1/1964 | United Kingdom | 220/18 |

*Primary Examiner*—Jimmy G. Foster
*Attorney, Agent, or Firm*—Brooks & Kushman

[57] ABSTRACT

A trash container adapted to be attached to an under-sink cabinet door having a flexible wall which yields upon contacting a garbage disposal or other obstruction when the door is closed. The trash container includes a back wall or other means for connecting the container to the inside of the cabinet door. The trash container is intended to receive a conventional plastic trash can liner. The bottom of the trash can liner is supported by a bottom panel which interconnects the bottom edge of the base wall and the bottom edges of the flexible wall. The base wall, back wall and flexible wall can be molded in one piece or may be formed by assembling the flexible wall to the back wall and base wall which may then be formed of a rigid polymer. Alternatively, means for mounting the flexible wall and base wall to the cabinet door are provided.

20 Claims, 1 Drawing Sheet

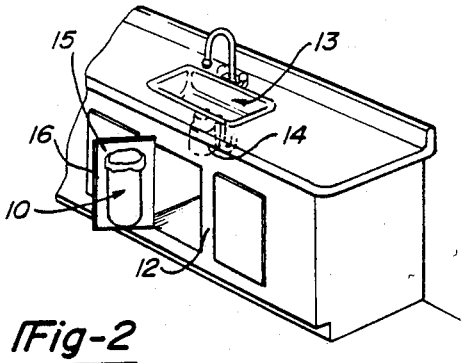
Fig-1
Fig-2
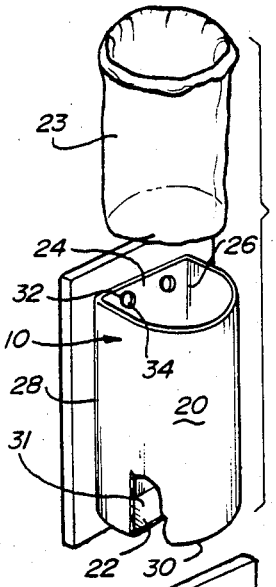
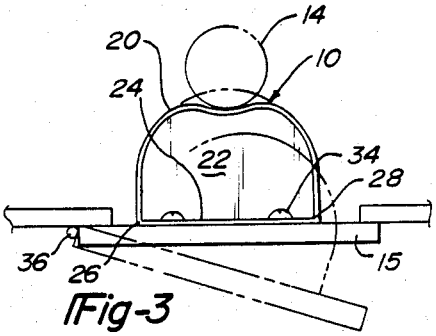
Fig-3
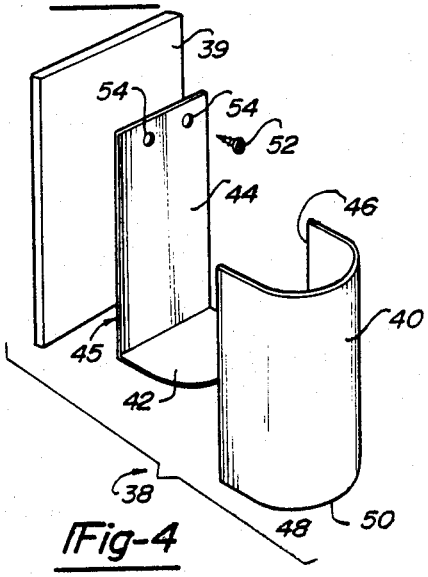
Fig-4
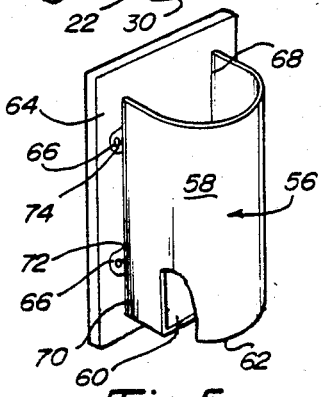
Fig-5

FLEXIBLE WALL TRASH CONTAINER FOR A CABINET DOOR

TECHNICAL FIELD

The present invention relates to trash receptacles and more particularly relates to undersink trash containers which are attached to a cabinet door.

BACKGROUND

The preferred location for a trash container in a kitchen is in a cabinet beneath the kitchen sink. This location is preferred generally because it is both convenient and out of the way.

Modern kitchens include obstructions, such as garbage disposals, auxiliary water heaters and plumbing parts within the cabinet under the kitchen sink. In particular, garbage disposals attach directly to the kitchen sink drain. Frequently, such obstructions preclude the use of a full size trash container, one suitable for use with tall kitchen trash can liners, beneath the sink. Tall kitchen trash can liners is the term currently used for 13 gallon trash can liners.

When a garbage disposal or other sizeable obstruction is located beneath the sink, in most instances, either a free standing trash container must be used or a very small trash container is used under the sink.

One prior art solution to this problem is proposed by U.S. Pat. No. 4,691,837 to Dillon which discloses a pivotable L-shaped trash container designed to be fitted under the sink. The L-shaped trash container pivots out when the cabinet door is opened to allow trash to be inserted into the container and then tipped up again by the closure of the door. One disadvantage of this trash container is that it would be unstable if excessive weight is placed in the top section of the container. The approach proposed by Dillon is limited to certain circumstances and plumbing designs wherein adequate space is provided between the cabinet and he interfering plumbing structure or garbage disposal.

Another approach to this problem is proposed by U.S. Pat. No. 4,664,455 to Greenhow which discloses a collapsible metal frame for retaining a trash can liner. The collapsible frame flattens partially upon closure of the cabinet door. One problem associated with this structure is the complexity of the frame linkage. Another disadvantage is that the multi-piece structure require assembly and may wear out in time. Rattling of the frame members upon opening and closing is also annoying.

The above disadvantages and problems are overcome by the simple and economical trash container of the present invention.

SUMMARY OF THE INVENTION

The present invention relates to a trash container which is attached to the inside surface of a cabinet door. The trash container is formed by a substantially semi-cylindrical flexible wall which is attached at right and left vertically extending edges to the inside surface of the cabinet door. A base wall is secured to a lower edge of the flexible wall and abuts against the inside surface of the cabinet door.

According to another aspect of the present invention, a trash container for supporting a trash can liner is attached to an inside surface of a cabinet door. The trash container is particularly well adapted for use in a cabinet which houses an obstruction. The trash container features a continuous flexible wall having a lower edge and right and left vertically extending edges. The flexible wall has an intermediate portion between the right and left vertically extending edges which is spaced from the cabinet door and defines a trash can liner receiving opening. The flexible wall is attached to the inside surface of the cabinet door by fasteners. The flexible wall is elastically deformed upon contact with the obstruction housed in the cabinet when the cabinet door is closed and recovers to its pre-deformed shape when the cabinet door is open.

In particular, the trash container of the present invention is adapted to support a trash can liner which is attached to an inside surface of a cabinet door of a cabinet which houses an obstruction, such as a garbage disposal or other plumbing elements. The trash container features a continuous and protruding flexible wall having a lower edge and right and left vertically extending edges. The flexible wall has an intermediate portion located between the right and left vertically extending edges which is spaced from the cabinet door and defines a trash can liner receiving opening. A base is secured to the lower edge of the flexible wall which extends between the lower edge and the cabinet door to support the trash can liner. The base has an abutting edge near the inside surface of the cabinet door. A back wall interconnects the right and left vertically extending edges of the flexible wall and the abutting edge of the base. The back wall includes openings for receiving fasteners that are secured to the inside of the cabinet door to thereby connect the back wall to the inside surface of the cabinet door. The protruding portion of the flexible wall is elastically deformed upon contact with the obstruction housed in the cabinet when the cabinet door is closed to its pre-deformed shape when the cabinet door is open.

The trash container of the present invention may be formed in a molding process as a unitary piece. Alternatively, the trash container may be formed from a flexible wall formed of a sheet of flexible elastomeric material with the base wall and back wall being formed of a substantially rigid sheet form material which are assembled together in an L-shaped subassembly. The flexible wall and the L-shaped subassembly may then be assembled together by conventional fasteners or an adhesive.

According to another aspect of the present invention, the trash container may include bracket flanges formed on the right and left vertically extending edges of the flexible wall which are adapted to be secured to the inside surface of the cabinet door. The bracket flanges may be used in place of, or in conjunction with, the back wall to perform the function of attaching the flexible wall to the inside surface of the cabinet door.

The trash container is preferably arcuately shaped and of a width and radius to permit unimpeded opening and closing of the cabinet door.

The flexible wall may be deformed upon contact with a fixed object when the cabinet door is closed but recovers to its substantially arcuate shape when the cabinet door is open. The force required to elastically deform the flexible wall should be less than the force required to open the cabinet door so that, at least when the container is not overfilled, the flexible wall will not prevent closure of the cabinet door or retention of the cabinet door in its closed position.

It is an object of the invention to provide a simple and inexpensive trash container which may be attached to a cabinet door of a cabinet which houses an obstruction.

It is another object of the present invention to provide a trash container which is sized to accept a full size (13 gallon) tall kitchen trash can liner.

It is another object of the present invention to provide a trash container for securing to the undersink cabinet door which permits trash to be stowed beneath the kitchen sink even when an obstruction such as a garbage disposal unit would prohibit the use of a tall kitchen garbage can beneath the sink.

It is another object of the present invention to provide a trash container for attachment to the inside surface of the cabinet door which is molded in one piece and includes a flexible wall which protrudes from the cabinet door.

It is another object of the present invention to provide a trash container having a rigid back and base portion which are fastened to a flexible wall and adapted to be attached to the inside surface of the cabinet door.

These and other objects are achieved and the problems noted above are overcome by the present invention. The invention will be better understood upon reference to the attached drawings and review of the following description of the drawings and of the preferred embodiments of the invention.

BRIEF DESCRIPTION OF THE DRAWINGS

FIG. 1 is a perspective view of a kitchen cabinet having the trash container of the present invention secured to the cabinet door of the undersink cabinet;

FIG. 2 is a perspective view of the trash container and a trash can liner;

FIG. 3 is a top plan view of the trash container of the present invention secured to a closed cabinet door with the container partially deformed by an obstacle and also showing the cabinet door partially open with the container undeformed in phantom lines;

FIG. 4 is an exploded perspective view showing an alternative embodiment of the trash container of the present invention; and FIG. 5 is a perspective view of an alterative embodiment of the trash container of the present invention.

DETAILED DESCRIPTION

Referring now to FIG. 1, the trash container 10 of the present invention is shown in conjunction with a cabinet 12 located beneath a kitchen sink 13. The cabinet 12 encloses an obstruction 14, such as a garbage disposal, an auxiliary water heater or plumbing parts. The trash container 10 is mounted on the cabinet door 15 on the inside surface 16 of the door 15.

Referring now to FIGS. 2 and 3, the trash container 10 of the present invention is shown to include a flexible wall 20 which is disposed in a substantially semi-cylindrical shape. By the term "substantially cylindrical", it should be understood that the shape of the wall is arcuate and may in fact be semi-circular, parabolic or U-shaped in a horizontal cross-section. The flexible wall is preferably formed from an elastomeric material. Suitable elastomers may include gum rubber, neoprene or latex. The material for the flexible wall 20 must be chosen so that it normally maintains an open shape but is elastically deformable upon contact with a fixed object under the cabinet door such as the garbage disposal 14. If desired, a guard bar (not shown) could be installed in the cabinet to hold the trash container 10 away from the garbage disposal 14 or other obstacle. The force required to elastically deform the flexible wall 20 is less than the force required to open the cabinet door 15.

A base wall 22 is formed at the bottom of the trash container 10. A trash can liner 23 is inserted into the trash container 10 and is supported by the base wall 22. A back wall 24 is part of the preferred construction of the trash container 10.

The flexible wall 20 includes right and left vertically extending edges 26 and 28 that are connected to the opposite sides of the back wall 24. The flexible wall 20 also has a lower edge 30 connected to the base wall 22. The base wall 22 and back wall 24 are connected at a flat edge 31 of the base wall 22. Openings 32 are formed in the back wall 24 to receive fasteners 34 for securing the trash container 10 to the door 15.

The door 15 is preferably connected by hinges 36 to the cabinet 12. The hinges 36 are preferably of the spring biased type which urge the door 15 to its closed position. Alternatively, a latch means (not shown) may be provided on the cabinet 12 and door 15 to hold the door in its closed position. In either embodiment, the force required to overcome the spring bias of the hinge or the grip of the latch is not overcome by the elasticity of the flexible wall 20 so that the door 15 will remain closed even if the flexible wall 20 is deformed by engagement with the garbage disposal 14 or other obstruction housed in the cabinet 12.

The trash container may be molded in one piece or assembled together from two or more separate pieces comprising the flexible wall 20, the base wall 22, and the back wall 24. The back and base walls may be made of rigid polymeric material, such as plexiglas, polystyrene or polyvinyl chloride, or another structural material such as wood. If so, the flexible wall 20 would be attached to the base and back walls by fasteners or adhesives to form the trash container 10.

Referring now to FIG. 4, an alternative embodiment of the trash container 38 is shown. The trash container 38 is shown attached to the inside of a cabinet door 99. The trash container 38 includes a flexible wall 40 which is preferably semi-cylindrical in shape.

A base wall 42 and back wall 44 of the trash container 38 are secured together in an L-shaped subassembly 45. Right and left vertically extending edges 46 and 48 of the flexible wall 40 and the lower edge 50 of the flexible wall 40 are secured to the sides of the back wall 44 and the edge of the base wall 42 which extends outwardly from the back wall 44. The L-shaped subassembly 45 is preferably adhesively secured to the flexible wall 40. Alternatively, mechanical fasteners could be used to secure the L-shaped subassembly 45 to the flexible wall 40. The back wall 44 is adapted to receive fasteners 52, such as screws in openings 54 formed in the back wall 44. The fasteners 52 secure the trash container 38 to the cabinet door 39.

Referring now to FIG. 5, an alternative embodiment of the trash container 56 of the present invention is shown. The trash container 56 includes a flexible wall 58 and a base wall 60 extending from the lower edge 62 of the flexible wall 58 to the cabinet door 64. Bracket flanges 66 are provided on the right and left vertically extending edges 68 and 70 of the flexible wall 58. The bracket flanges 66 each define an opening 72 for receiving a fastener 74 for securing the trash container 56 to the cabinet door 64.

The foregoing description of several embodiments of the present invention is provided by way of example and not in a limiting sense. The scope of the invention is defined by the following claims.

I claim:

1. A trash container for attachment to an inside surface of a cabinet door comprising:

a flexible wall disposed in a substantially semi-cylindrical shape and having a lower edge and right and left vertically extending edges;

a base wall secured to the lower edge of said flexible wall and having a flat edge for abutting against the inside surface of the cabinet door; and means for attaching said flexible wall to the inside surface of the cabinet door.

2. The trash container of claim 1 wherein said means for attaching comprises a back wall connecting said right and left vertically extending edges of said flexible wall and said flat edge of said base wall, said back wall being adapted to receive fasteners for connecting the back wall to the inside surface of the cabinet door.

3. The trash container of claim 2 wherein openings are formed in the back wall to receive fasteners secured to the inside of the cabinet door.

4. The trash container of claim 2 wherein said flexible wall, said base wall, and said back wall are all formed together in a molding process as a unitary piece.

5. The trash container of claim 2 wherein said flexible wall is a sheet of flexible elastomeric material, said base wall and said back wall are formed of a substantially rigid sheet form material and assembled together in an L-shaped subassembly, and said flexible wall and L-shaped subassembly are assembled together.

6. The trash container of claim 1 wherein said means for attaching comprises a plurality of bracket flanges on the right and left vertically extending edges of the flexible wall are secured to the inside surface of the cabinet door.

7. The trash container of claim 1 wherein said flexible wall is elastically deformable upon contact with a fixed object when the cabinet door is closed and recovers to its substantially arcuate shape when the cabinet door is opened.

8. The trash container of claim 7 wherein the force required to elastically deform said flexible wall is less than the force required to hold the cabinet door open.

9. A trash container for supporting a trash can liner and being adapted to be attached to an inside surface of a cabinet door of a cabinet having an obstruction housed in the cabinet comprising:

a continuous flexible wall having a lower edge and right and left vertically extending edges, said flexible wall having an intermediate portion between said right and left vertically extending edges, said intermediate portion being spaced from the cabinet door and defining a trash can liner receiving opening;

means secured at the lower edge of said flexible wall and extending between said lower edge and the cabinet door for supporting the trash can liner; and means for attaching said flexible wall to the inside surface of the cabinet door, whereby said flexible wall is elastically deformed upon contact with the obstruction when the cabinet door is closed and recovers to its predeformed shape when the cabinet door is opened.

10. The trash container of claim 9 wherein said means for attaching comprises a back wall connecting said right and left vertically extending edges of said flexible wall, said back wall defining means for receiving fasteners to connect the back wall to the inside surface of the cabinet door.

11. The trash container of claim 10 wherein said means for receiving fasteners comprises openings formed in the back wall to receive fasteners secured to the inside of the cabinet door.

12. The trash container o claim 10 wherein said flexible wall and said back wall are formed together in a molding process as a unitary piece.

13. The trash container of claim 10 wherein said flexible wall is a sheet of flexible elastomeric material and said back wall is formed of a substantially rigid sheet form material, and said flexible wall and back wall being assembled together.

14. The trash container of claim 9 wherein said means for attaching comprises a plurality of bracket flanges on the right and left vertically extending edges of the flexible wall which are secured to the inside surface of the cabinet door.

15. The trash container of claim 9 wherein said flexible wall is maintained in a substantially arcuate shape and recovers to its substantially arcuate shape when the cabinet door is opened.

16. The trash container o claim 15 wherein the force required to elastically deform said flexible wall is less than the force required to hold open the cabinet door.

17. A trash container adapted to support a trash can liner and to be attached to an inside surface of a cabinet door of a cabinet having an obstruction housed in the cabinet comprising:

a continuous protruding flexible wall having a lower edge and right and left vertically extending edges, said flexible wall having an intermediate portion between said right and left vertically extending edges which is spaced from the cabinet door and defining a trash can liner receiving opening;

a base secured to the lower edge of said flexible wall and extending between said lower edge and the cabinet door for supporting the trash can liner and having an edge abutting the inside surface of the cabinet door; and a back wall connecting said right and left vertically extending edges of said flexible wall and the edge of said base, said back wall defining openings to receive fasteners secured to the inside of the cabinet door to connect the back wall to the inside surface of the cabinet door, whereby said flexible wall is elastically deformed upon contact with the obstruction when the cabinet door is closed and recovers to its predeformed shape when the cabinet door is opened.

18. The trash container of claim 17 wherein said flexible wall, said base, and said back wall are all formed together in a molding process as a unitary piece.

19. The trash container of claim 17 wherein said flexible wall is a sheet of flexible elastomeric material, said base and said back wall are formed of a substantially rigid sheet form material and assembled together in an L-shaped subassembly, and said flexible wall and L-shaped subassembly are adhesively fastened together.

20. The trash container of claim 17 wherein the force required to elastically deform said flexible wall is less than the force required to open the cabinet door.

* * * * *

UNITED STATES PATENT AND TRADEMARK OFFICE

CERTIFICATE OF CORRECTION

PATENT NO. : 4,911,325

DATED : March 27, 1990

INVENTOR(S) : John P. De Giulio

It is certified that error appears in the above-identified patent and that said Letters Patent is hereby corrected as shown below:

| | |
|---|---|
| On the title page, in the References Cited: | (The First Reference) "D. 29,381 3/1988" should be --D. 293,813 1/1988--. |
| Column 1, Line 39 | "he" should be --the--. |
| Column 1, Line 48 | "require" should be --requires--. |
| Column 4, Line 39 | "99" should be --39--. |
| Column 6, Line 9, Claim 12 | "o" should be --of--. |
| Column 6, Line 26, Claim 16 | "o" should be --of--. |

Signed and Sealed this

Twenty-fifth Day of June, 1991

*Attest:*

*Attesting Officer*

HARRY F. MANBECK, JR.

*Commissioner of Patents and Trademarks*